United States Patent [19]

Sines

[11] 4,015,845

[45] Apr. 5, 1977

[54] AUTOMATIC CUE BALL SEPARATING AND RETURN ASSEMBLY FOR BILLIARD TABLES

[76] Inventor: Randy D. Sines, 601 5th Ave. S., Apt. 2, Great Falls, Mont. 59405

[22] Filed: Feb. 17, 1976

[21] Appl. No.: 658,251

[52] U.S. Cl. ..... 273/11 C; 209/81 R; 209/111.8; 273/124 A; 273/179 A; 273/59 A

[51] Int. Cl.[2] ..... A63D 15/00

[58] Field of Search ..... 273/11 C, 11 R, 10, 273/14, 179 A, 121 A, 122 A, 124 A, 125 A, 47, 48, 49, 51, 59 R, 59 A, 59 B, 54 R; 209/81 R, 81 A, 111.5, 111.8

[56] References Cited

UNITED STATES PATENTS

| | | | |
|---|---|---|---|
| 1,885,662 | 11/1932 | Whitehorn | 273/49 UX |
| 2,045,769 | 6/1936 | Geffcken et al. | 209/81 R X |
| 2,448,814 | 9/1948 | Mann et al. | 209/81 R |
| 2,577,892 | 12/1951 | Hatton et al. | 209/81 R X |
| 2,610,059 | 9/1952 | Koci | 273/124 A X |
| 2,642,974 | 6/1953 | Ogle | 209/81 R X |
| 2,902,645 | 9/1959 | Wallenfang | 209/81 R X |
| 3,362,710 | 1/1968 | Feddick et al. | 273/11 C |
| 3,424,456 | 1/1969 | Daddis | 273/11 C |
| 3,447,804 | 6/1969 | Cornell | 273/49 X |
| 3,501,147 | 3/1970 | Uecker | 273/49 |
| 3,796,434 | 3/1974 | Moss et al. | 273/179 A |

FOREIGN PATENTS OR APPLICATIONS

| | | | |
|---|---|---|---|
| 405,182 | 12/1967 | Australia | 273/11 C |

*Primary Examiner*—Richard C. Pinkham
*Assistant Examiner*—Arnold W. Kramer
*Attorney, Agent, or Firm*—Wells, St. John & Roberts

[57] ABSTRACT

An assembly for identifying and separating a cue ball, on a single file ball return run of a billiard table, from a group of object balls with the cue ball being substantially identical in weight and size to the object balls. The assembly includes a cue ball having a metallic core encapsulated by a phenolic resin shell. An electrically produced field (static or electromagnetic) is located in the path of all balls moving along the single file return run. Sensing apparatus is connected to the field-producing element to detect when the field is distorted or otherwise interrupted by passage of the metallic core ball. A signal is produced in the circuitry in response to interruption of the field by the metal core ball. The produced signal is utilized to operate a relay which in turn, completes a circuit to a kicker solenoid. The solenoid is positioned along the return run opposite the opening of a separate cue ball return run. The kicker solenoid operates to move its plunger against the cue ball and push it through a gate onto the cue ball return run.

9 Claims, 6 Drawing Figures

AUTOMATIC CUE BALL SEPARATING AND RETURN ASSEMBLY FOR BILLIARD TABLES

BACKGROUND OF THE INVENTION

The present invention is related to the field of billiard table accessories and more particularly to such accessories that perform the function of separating a cue ball from a number of object balls in order to deliver the cue ball to an access point different from that of the object balls.

In coin-operated billiard tables, it has long been a problem to successfully separate the cub ball from object balls once the cue ball has been inadvertently "scratched" or dropped into one of the table's six pockets. Ordinarly such tables are provided with return runs for the object balls that lead from each pocket to a common single file run. Balls received in any of the six pockets will roll to the common single file return run and finally roll out into an access area. A coin-operated door is normally situated at the access area to prevent the balls from being removed therefrom until a coin is inserted. Thus it is desirable to be able to retrieve a scratched cue ball without having to use a second coin.

The problem of separating the cue ball from the remaining object balls along a single file return run has been approached from several directions; some with partial success. Probably the most used approach involves using a cue ball that is larger than the object balls. In this situation a cue ball is manufactured with a slightly larger diameter than the object balls. Therefore, physical contact elements may be utilized along the single-file run to pick the cue ball out from the remaining object balls and direct it along a separate path to a free access position. Another method involves providing a cue ball that has a ferrous core that is responsive to a permanent magnet located along the single-file run. The magnet operates to magnetically pull or push the cue ball from the object ball return run to the cue ball return run.

Both of the solutions discussed above have inherent difficulties. Firstly, an oversized cue ball will react very differently with the object balls than would a cue ball of standard size. For this reason, the oversized cue balls are not utilized or permitted in regulated, highly competitive games. An additional problem is that the cushion around the playing area is set to be a distance above the playing surface equal to the radius of an object ball. Therefore, the center of mass for the oversized cue ball is slightly over center when the cue ball strikes the cushion. Often, the outcome is that the oversized cue ball will "jump the rail" where a regular sized cue ball will remain on the playing surface.

The basic problem with the magnetic deflection technique is that the cue balls must have a core of magnetic material. The core material (usually a ferrous alloy) has a specific gravity much greater than the specific gravity of the phenolic resin material utilized to form an ordinary cue ball, thus increasing the weight of the cue ball beyond standard limits.

In consideration of the above described difficulties, it has become very desirable to obtain some form of cue ball separating assembly that may be used in conjunction with coin-operated billiard tables or other tables having a separate cue ball return wherein the cue ball is identical in size and weight to the object balls.

It is a primary object of the present invention to provide an assembly including a metallic core cue ball that is equal in size and weight to regulation object balls.

It is an additional object to provide such an assembly that may be effectively utilized with relatively any billiard table having a single file ball return run leading to an object ball access and a separate interconnecting cue ball return run.

An additional object is to provide such an assembly that may be energized or de-energized at will, thereby conserving its electrical supply source.

A still further object is to provide such an assembly that may be relatively inexpensive to purchase and maintain.

A still further object is to provide such an assembly that facilitates quick recovery of the cue ball once it is scratched or dropped into one of the six ball pockets.

These and still further objects and advantages will become apparent upon reading the following detailed description of the preferred embodiment which, taken with the accompanying drawings, disclose preferred and alternate forms of my invention. It should be understood that the following specification is not provided for the purpose of placing restrictions upon the scope of my invention. Only the claims found at the end of this application are to be taken as definitions of my invention.

BRIEF DESCRIPTION OF THE DRAWINGS

Preferred and alternate forms of the present invention are illustrated in the accompanying drawings in which.

DETAILED DESCRIPTION OF PREFERRED AND ALTERNATE EMBODIMENTS

Figure 2:
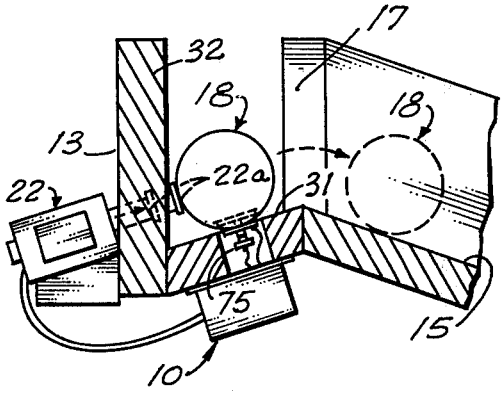
FIG. 2 is an enlarged sectional view of the separating and return assembly.

The present assembly is generally designated by reference character 10 in FIG. 2 of the accompanying drawings. Basically, it is intended that the assembly be used with a billiard table of the conventional coin-operated configuration. Such tables have six ball receiving pockets 11 and include individual ball runs 12 that empty into a common single file run 13. Object balls are returned to a coin-operated access or receptacle 14. The cue ball, however, is separated from the object balls at junction or intersection 17 to return along its own run 15 to an open cue ball access or receptacle 16. It is necessary that the cue ball be separated and returned independently of the object balls. Otherwise it would be necessary to pay for a new game in order to retrieve the cue ball after scratching or inadvertently dropping the cue ball into one of the six pockets.

The present assembly includes a metallic core cue ball 18. An electrical field producing means 20 (FIGS.

4–6) is stationed along the run 13 adjacent the junction 17. Electrical means 20 produces an electrostatic or electromagnetic field that may be distorted or otherwise affected by the metallic core cue ball 18 as it rolls through the field. A detecting means 21 is included that is sensitive to changes in the field produced thereby. Detecting means 21 produces a signal in response to distortion of the field by cue ball 18. A kicker means 22 is operatively associated with the detecting means and is responsive to the signal for engaging and deflecting the cue ball from the run 13 onto the cue ball return run 15. The assembly is operated by an independent power source 23. This source 23 may be a battery as shown in the drawings, or may be ordinary household current.

Figure 3:
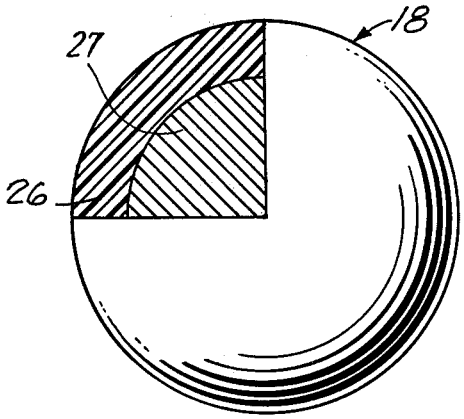
FIG. 3 is an enlarged quarter sectional view of a cue ball for the present invention.

The cue ball 18 is shown in substantial detail by FIG. 3 of the drawings. It is comprised of a shell 26 that encapsulates a metallic core 27. The shell 26 is comprised of conventional phenolic resin that is presently being used as a standard material in the production of billiard balls (both object and cue balls). Various metal cores may be utilized, however, it is preferable to use an aluminum or aluminum alloy. It is preferable to use this material as the core material since its specific gravity is relatively close to the surrounding resin material. Therefore, the total weight of the cue ball may be easily adjusted to the exact specification determined by present standards. In practice, a cue ball has been produced that weighs 6 ounces (within allowable tolerances) and has a diameter of 2¼ inches. This size and weight is substantially identical to corresponding regulation object balls.

It is also understood that cores of various configurations may be utilized and may be as effective as the solid core ball shown by FIG. 3. For example, a foil layer could easily be located just beneath the outer ball surface or one or more metallic loops could be suspended symmetrically in the resin material.

Single file run 13 includes an inclined floor section 31. The floor section 31 is inclined downwardly and away from the open junction 17 with cue ball run 15. An upright retainer wall 32 is provided to guide the balls along run 13.

Figure 4:
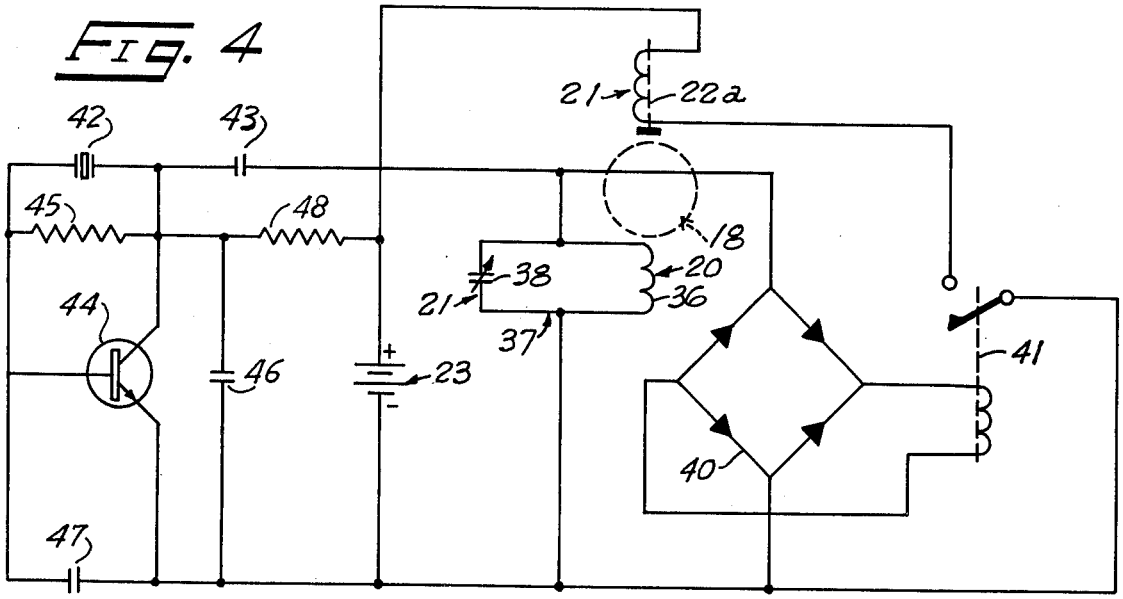
FIG. 4 is a wiring diagram illustrating a preferred form of the electrical components and their arrangement.
Figure 5:
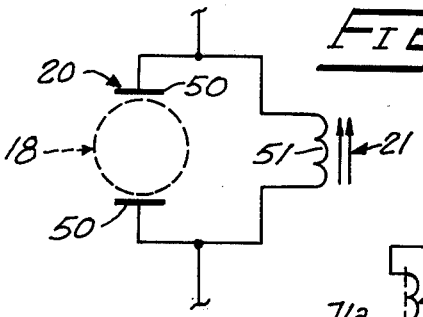
FIG. 5 is a fragmentary schematic illustrating an alternate form of the circuitry shown by FIG. 4.
Figure 6:
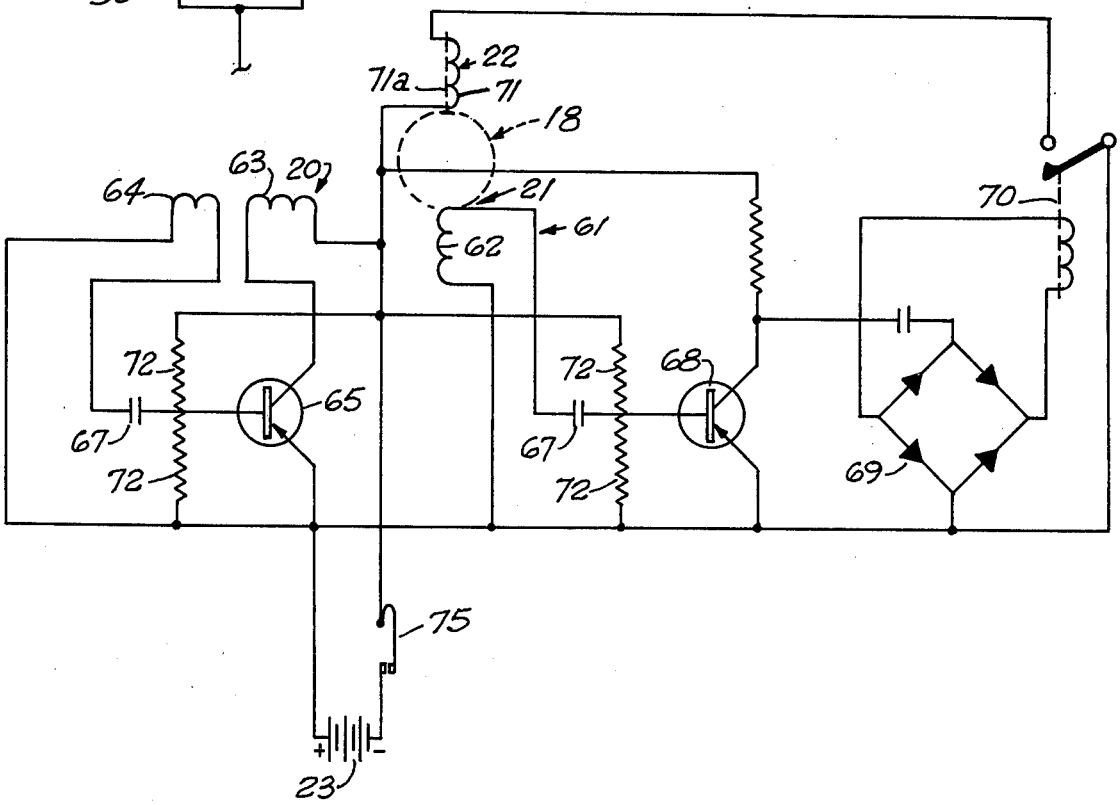
FIG. 6 shows another alternate form of circuitry for the present invention.

The structure and operation of field producing means 20, detecting means 21, and kicker means 22 may best be understood with reference to FIGS. 4 through 6. FIG. 4 illustrates a preferred form of the circuitry utilized with the present invention while FIGS. 5 and 6 illustrate alternate forms by which separation of the cue ball from the return run 13 may be accomplished.

FIG. 4 illustrates the cue ball 18 by dashed lines to promote an operational understanding of the preferred form of the present assembly. In this configuration, the field producing means 20 is comprised of a simple inductor coil 36 that is located along the single file run 13 adjacent junction 17.

An oscillating electromagnetic field is produced by the inductor coil through power source 23 and conventional "Pierce" type oscillator circuit interposed therebetween. Inductor 36 is a component of a tank circuit 37. The remaining component of circuit 37 consists of a condenser 38 connected in parallel with coil 36. Condenser 38 is variable to "tune" the tank circuit to resonance, whereby the capacitive reactance of condenser 38 is equal to the inductive reactance of induction coil 36.

While tank circuit 37 is resonant, current may pass freely to a bridge rectifier 40 and on to a normally closed relay 41. This current may be sufficient to maintain the relay in an energized state or it may be amplified by known means to energize a less sensitive relay. The relay is normally closed so that when energized, its contacts are opened. When the metallic core of the cue ball moves through the electromagnetic field of inductor 36, the inductive reactance changes, removing the tank circuit from resonance. Therefore, no current is allowed to pass through the tank circuit to bridge 40 and subsequently to relay 41. In response, the relay becomes momentarily de-energized and its contact move to a closed position. This completes a circuit that includes the power source 23 and kicker means 22. Current delivered to means 22 activates the solenoid coil to move its core 22*a* outwardly, physically pushing the cue ball from run 13 to run 15.

In the above circuitry, the detecting means 21 includes the variable condenser 38 which responds to changing inductive reactance of inductor coil 36 by sending a corresponding "signal" to relay 41. The signal produced in this instance is a brief break in current flow through the tank circuit to relay 41.

The oscillator circuit that feeds the tank is conventionally known as a Pierce oscillator circuit. It utilizes a crystal 42 to feed oscillating current at a selected frequency to the tank 37. This type of circuit will oscillate at frequencies ranging from high audio to radio frequency, depending upon the frequency value of crystal 42. To protect the crystal against voltage strain, a condenser 43 is connected in series on one side thereof.

Also included in the oscillator circuit is a transistor 44. The crystal is shunted across the collector and base of transistor 44 by a resistor 45. A condenser 45 is connected in parallel with the transistors, collector and emitter, and another condenser 47 is connected in series between the emitter and base. A load resistor 48 is also connected in series with shunt resistor 45.

Further discussion of details concerning the oscillator circuit will not be made in this specification since such circuitry is relatively well-known in the art, particularly in the communication industry. Further, I do not intend to restrict my invention to such oscillator circuitry, since other forms of oscillator circuits may be effectively utilized that do not require a crystal for determining frequency.

An alternate field producing means 20 is shown in fragmentary form by FIG. 5. Basically, this form is an alternate of the tank circuit 37 and may be interchanged with that part of the circuit shown in FIG. 4. In this form, a condenser 50 is provided with plates thereof spaced apart on opposite sides of the single file return run 13. A cue ball is shown in dashed lines between the plates of condenser 50. A variable inductance coil 51 is also provided in this circuit. Coil 15 is adjustable in order to tune this particular tank circuit to resonance.

Operation of this circuit is similar to that described for the tank circuit shown in FIG. 4 except that an electrostatic field is produced between the plates of condenser 50. The metallic core of the cue ball 18 will drastically affect the capacitance between the condenser plates and thereby upset the resonant quality of the tank circuit. The coil 51 in this form is included as an element of detecting means 21 and operates as does the condenser 38 described above.

Still another example of a field producing, detecting and signal producing circuit is shown by FIG. 6 of the drawings. In this example, a "coupled field locater circuit" 61 is utilized to distinguish the cue ball. Field producing means 20 and detecting means 21 are combined in this instance and are comprised of a pickup coil 62 that is inductively coupled to a collector coil 63. Oscillation is produced through the collector coil 63 and a base coil 64. A transistor 65 is connected in a common emitter circuit to coils 63 and 64 with the base connected to coil 64 through a series coupling condenser 67 and with the collector connected to coil 63. The emitter is connected to the positive side of power source 23.

A second transistor 68 is connected to the coil 62 through another coupling condenser 67. Transistor 68 is utilized to amplify a signal produced through the coupled coils and to send the signal along through a bridge rectifier 69 and subsequently to a normally open relay 70. A number of bias voltage resistors 72 are connected across the bases of both transistors and to the positive side of battery power source 23.

This circuitry provides that the coils 62 and 63 operate in a 180° out of phase relationship. Therefore, no voltage is induced into the coil 62 through the oscillating electromagnetic field coupling between the two coils. However, when the metallic core of cue ball 18 moves through the coupling field, the metal will distort the field and change the phase angle, thereby inducing a voltage in the sensor coil 62. This induced voltage signal is amplified by the transistor 68 and is passed along to the bridge rectifier 69. Subsequently the rectified signal produced through bridge 69 is passed along to activate relay 70. Since the relay 70 is held normally open, it will close when energized and thereby complete a circuit to the kicker solenoid 71. In response, the kicker solenoid plunger 71a will move outwardly and bump the cue ball from run 13 onto the cue ball return run 16.

It should be noted that varying stages of amplification may be utilized to intensify signals produced by the embodiments shown in the accompanying drawings. For example, one or more transistor amplifiers may be connected in the circuitry shown by FIG. 6 between the bridge rectifier 69 and relay 70. The required operating sensitivity of relay 70 may therefore be appreciably reduced by such amplification.

It is also conceivable that the resonance circuit described for the preferred embodiment could be tuned to resonance with the cue ball adjacent the inductor or between capacitor plates. Thus the tank circuit would be brought into resonance as the cue ball moves into the field. In this case, a normally open relay could be used since the signal produced would be a current impulse rather than a momentary interruption of a continuous current flow.

Figure 1:
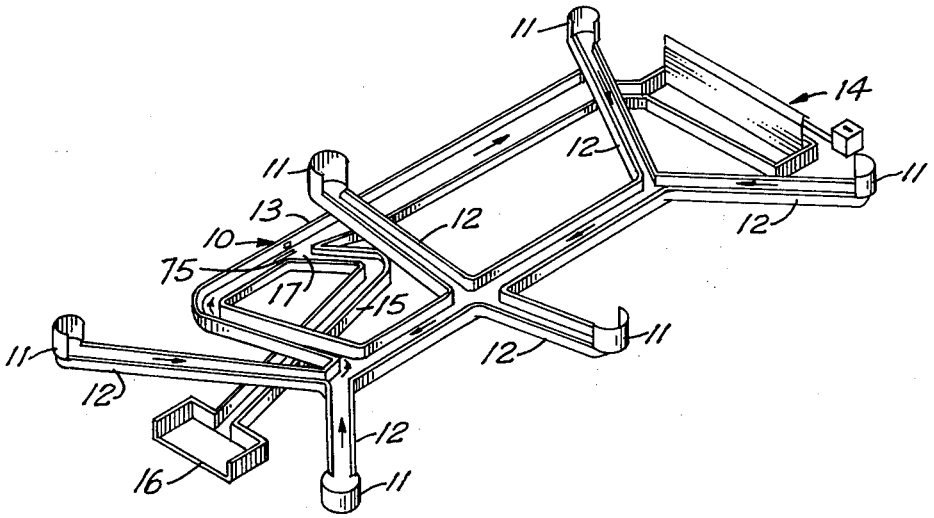
FIG. 1 is a schematic pictorial view of a ball return system employing the present invention.

The power source 23 is shown in both embodiments of the circuitry as being a battery. To obtain optimum useful life for the battery, a switch 75 (FIG. 2) may be provided that is operated by a ball moving along a single file return run 13. Such a switch as shown in FIGS. 1, 2 and 6 is normally sprung open but will close in response to movement of a ball past the junction 17 and then reopen once the ball becomes disengaged therewith. Alternatively a simple momentary contact switch may be utilized in combination with a time delay whereby a ball closing the switch would actuate the time delay — which, in turn, would energize the circuitry until sufficient time has passed for the ball to roll through the field. In this manner, the circuitry would be operative or "armed" only when required. Otherwise, the sensing apparatus, whether it be an inductance coil or a capacitor, would be armed continually as shown by FIG. 4.

Operation of the present invention may be easily understood. During the course of a billiard game object balls are received by any of the six pockets 11 and directed through the runs 12 to the single file run 13. Occasionally the cue ball will be scratched and also return via one of the runs 12 to the single file run 13.

In moving past the switch 75 (if provided), both the object balls and the cue ball will actuate the above described circuitry. As this happens, an oscillating electromagnetic or oscillating electrostatic field is formed across the area adjacent to junction 17. An object ball may roll freely through this field without affecting the components of the circuitry. However, when the metal core cue ball rolls by, the field is correspondingly affected. This change is sensed by the detecting means 21, and in response, the kicker means 22 is actuated to push the cue ball onto the separate cue ball return run 15. The cue ball will move to a free access position at an end of the table opposite the object ball access 14.

It may have become obvious upon reading the above description and upon examining the attached drawings that various changes and modifications may be made therein without departing substantially from the scope of this invention. It is therefore intended that only the following claims be taken as restrictions upon the scope of my invention.

What I claim is:

1. An automatic cue ball separating and return assembly for billiard tables of the type having six ball receiving pockets with ball return runs leading from the pockets to a common single file run and with an object ball access opening at an end of the run and a separate cue ball return run leading from a junction with the single file return run to a separate cue ball access opening, said assembly comprising:

a cue ball having a solid smooth spherical outer shell encapsulating a metallic core member and being equal in size and weight to the object balls;

means for electrically producing an oscillating electrical field at a location along the single file run;

wherein said field is distorted by the metallic core of the cue ball but is relatively insensitive to non-metallic object balls;

detecting means for responding to disruption of the electrical field and for producing a signal in response thereto; and kicker means adjacent the juncture of the single file run and cue ball return run operated in response to the signal to force the cue ball from the single file run onto the cue ball return run.

2. The assembly as defined by claim 1 wherein the electrical field producing means includes an inductor coil that is sensitive to the presence of the metallic cue ball core.

3. The assembly as defined in claim 1 wherein the electrical field producing means includes a condenser having an electrostatic field between plates of the condenser with the plates located on opposite sides of the single file return run so that passage of the cue ball between the plates will disrupt the electrostatic field and substantially change the capacitance between the plates.

4. The assembly as defined by claim 1 wherein the kicker means is comprised of a solenoid having its plunger oriented for movement in a direction transverse to the single file run and located on a side thereof opposite the junction of the single file run and the cue ball return run.

5. The assembly as defined by claim 1 wherein the single file run adjacent the junction has a floor section that is inclined downwardly from the cue ball return run.

6. The assembly as defined by claim 1 wherein the electrical field is produced by inductance between two spaced coils set 180° out of phase in an oscillator circuit so that distortion of the field by the metallic core induces a signal voltage in one of the coils and wherein the kicker means is operatively connected to the one coil and is actuated by said signal.

7. The assembly as defined by claim 1 wherein the cue ball metal core contains aluminum.

8. The assembly as defined by claim 7 wherein the cue ball is 2¼ inches in diameter and weighs 6 ounces.

9. The assembly as defined by claim 1 wherein the field producing means is powered by a direct current voltage source and there is further included a switching means operatively connecting the voltage source with the field producing means and mounted to the single file return run for operation in response to engagement by a ball moving along the run to complete a circuit and render the assembly operative while the ball rolls through the field.

* * * * *